US005947716A

United States Patent [19]

Bellamy et al.

[11] Patent Number: 5,947,716

[45] Date of Patent: Sep. 7, 1999

[54] BREECH LOCK HEAT SHIELD FACE FOR BURNER NOZZLE

[75] Inventors: Kevin Gerard Bellamy, Church Hill; Woodward Clinton Helton, Kingsport; Daniel Isaiah Saxon, Kingsport; Stacey Elaine Swisher, Kingsport; Gary Scott Whittaker, Kingsport, all of Tenn.

[73] Assignee: Eastman Chemical Company, Kingsport, Tenn.

[21] Appl. No.: 08/833,452

[22] Filed: Apr. 7, 1997

[51] Int. Cl.[6] ..... F23D 11/00; F23C 7/00; B05B 15/00; B05B 1/28

[52] U.S. Cl. ..... 431/159; 431/187; 431/154; 431/160; 239/288.5; 239/132.3

[58] Field of Search ..... 431/159, 187, 431/160, 154; 239/103, 132, 132.3, 288, 288.3, 397.5, 288.5, 600, DIG. 19; 285/200, 401, 402, 403, 404, 414, 415, 901; 362/437

[56] References Cited

U.S. PATENT DOCUMENTS 2,809,104 10/1957 Strasser et al. ..... 48/215

4,502,633 3/1985 Saxon ..... 239/132.3

*Primary Examiner*—Ira S. Lazarus
*Assistant Examiner*—David Lee
*Attorney, Agent, or Firm*—Harry J. Gwinnell; Matthew W. Smith; Susan F. Wagner

[57] ABSTRACT

The water jacket face of a burner nozzle for a synthesis gas generator is protected from hot gas corrosion by an annular heat shield of high temperature melting point material. The shield material is formed into two ceramic rings that face or cover the nozzle water jacket face. A circular joint between the outer perimeter of an interior shield annulus is stepped to provide a protective lap with the interior perimeter of an exterior shield annulus. The interior ceramic ring is secured in place around the burner nozzle orifice by external lugs projecting radially from the nozzle extruder lip. A second set of external lugs is provided around the outer perimeter of the water jacket face. Internal sectors within a perimeter cuff bracket secure the outer ceramic ring to the water jacket face.

13 Claims, 5 Drawing Sheets

BREECH LOCK HEAT SHIELD FACE FOR BURNER NOZZLE

BACKGROUND OF THE INVENTION

The present invention relates to apparatus for practicing a partial oxidation process of synthesis gas generation. In particular, the present invention is applicable to the generation of carbon monoxide, carbon dioxide, hydrogen and other gases by the partial combustion of a particulate hydrocarbon such as coal in the presence of water and oxygen.

Synthesis gas mixtures essentially comprising carbon monoxide and hydrogen are important commercially as a source of hydrogen for hydrogenation reactions and as a source of feed gas for the synthesis of hydrocarbons, oxygen-containing organic compounds or ammonia.

The partial combustion of a sulfur bearing hydrocarbon fuel such as coal with oxygen-enriched air or with relatively pure oxygen to produce carbon monoxide, carbon dioxide and hydrogen presents unique problems not encountered normally in the burner art. It is necessary, for example, to effect very rapid and complete mixing of the reactants, as well as to take special precautions to protect the burner or mixer from over heating.

Because of the reactivity of oxygen and sulfur contaminants with the metal from which a suitable burner may be fabricated, it is imperative to prevent the burner elements from reaching those temperatures at which rapid oxidation and corrosion takes place. In this respect, it is essential that the reaction between the hydrocarbon and oxygen take place entirely outside the burner proper and that localized concentration of combustible mixtures at or near the surfaces of the burner elements is prevented. Even though the reaction takes place beyond the point of discharge from the burner, the burner elements are subjected to heating by radiation from the combustion zone and by turbulent recirculation of the burning gases.

For these and other reasons, prior art burners are characterized by failures due to metal corrosion about the burner tips: even when these elements have been water cooled and where the reactants have been premixed and ejected from the burner at rates of flow in excess of the rate of flame propagation.

It is therefore an object of the present invention to provide a novel burner for synthesis gas generation which is an improvement over the shortcomings of prior art appliances, is simple in construction and economical in operation.

Another object of the invention is to provide a synthesis gas generation burner nozzle having a greater operational life expectancy over the prior art.

Another object of the present invention is to provide a gas generation burner nozzle for synthesis gas generation having a reduced rate of corrosion.

A further object of the present invention is the provision of a burner nozzle heat shield to protect metallic elements of the nozzle from corrosive combustion gases.

Also an object of the present invention is a mechanical apparatus for securing a ceramic heat shield to a burner nozzle surface.

A still further object of the present invention is a ceramic heat shield assembly to control corrosion on a burner nozzle.

SUMMARY OF THE INVENTION

These and other objects of the invention as will become apparent from the detailed description of the preferred embodiment to follow are achieved by a substantially symmetric, axial flow fuel injection nozzle serving the combustion chamber of a synthesis gas generator. The nozzle is configured to have an annular slurried fuel stream that concentrically surrounds a first oxidizer gas stream along the axial core of the nozzle.

A second oxidizer gas stream surrounds the fuel stream annulus as a larger, substantially concentric annulus.

The fuel stream comprises a pumpable slurry of water mixed with finely particulated coal. The oxidizer gas contains substantial quantities of free oxygen for support of a combustion reaction with the coal.

A hot gas stream is produced in the refractory-lined combustion chamber at a temperature in the range of about 700° C. to about 2500° C. and at a pressure in the range of about 1 to about 300 atmospheres and more particularly, about 10 to about 100 atmospheres. The effluent raw gas stream from the gas generator comprises hydrogen, carbon monoxide, carbon dioxide and at least one material selected from the group consisting of methane, hydrogen sulfide and nitrogen depending on the fuel and reaction conditions.

Radially surrounding an outer wall of the outer oxidizer gas channel is an annular cooling water jacket terminated with a substantially flat end-face heat sink aligned in a plane substantially perpendicular to the nozzle discharge axis. Cool water is circulated from outside the combustion chamber into direct contact with the backside of the heat sink end-face for conductive heat extraction.

Combustion reaction components comprising the fuel and oxidizer are sprayed under significant pressure of about 80 bar into the combustion chamber of the synthesis gas generator. A torroidial circulation pattern within the combustion chamber carries hot gas along an axially central course out from the nozzle face. Distally from the nozzle face, the gases begin to cool and spread radially outward toward the chamber walls. While most of the combustion product and resulting synthesis gas is drawn from the combustion chamber into a quench vessel, some of the synthesis gas recirculates against the combustion chamber walls toward the nozzle end of the chamber, all the while transferring heat to the refractory wall.

The heat shield of the present invention comprises, for example, a pair of rings formed from high temperature melting point materials selected to tolerate temperatures in excess of 1400° C. Additionally, materials suitable for heat shield fabrication should include a resistance to a highly reducing/sulfidizing environment and provide a high coefficient of expansion.

To better accommodate the extreme thermal stress of the combustion chamber environment, each ring is a full annulus about the nozzle axis that faces or shields only a radial portion of the entire water jacket face annulus. An inner ring is mechanically secured to the metallic nozzle structure by meshing segments about the nozzle axis. The external elements of these segments, characterized here as lugs, are integral projections from the external cone surface of the nozzle lip. Each of three, for example, lugs projecting from the external cone lip is an arcuate portion of an independent ring fin. Each lug spans an arc of about (180÷N) degrees of arc angle were N is the number of lugs in a full circle.

The internal perimeter of the inner heat shield ring is formed with a channel having three, for example, wall cuts to receive and pass the respective external lug elements. When assembled, the inner heat shielding ring is secured against rotation by a spot welded rod of metal that is applied to the nozzle cooling jacket face within a notch in the outer perimeter of the inner ring.

Additionally, the outer perimeter of the inner heat shield ring is formed with an approximately half thickness step ledge that overlaps a corresponding step ledge on the internal perimeter of an outer heat shield ring.

The outer heat shield ring is secured to the water jacket face by a second set of external lug elements projecting from the outer perimeter of the water jacket face. A cuff bracket around the perimeter of the outer heat shield ring provides a structural channel for receiving the outer set of water jacket lugs. The outer heat shield ring is also held in place by a tack-welded rod or bar.

BRIEF DESCRIPTION OF THE DRAWINGS

Further objects and characteristics of the invention will be understood from the following description of the preferred embodiment taken in connection with the drawings wherein.

DESCRIPTION OF THE PREFERRED EMBODIMENT

Figure 1:
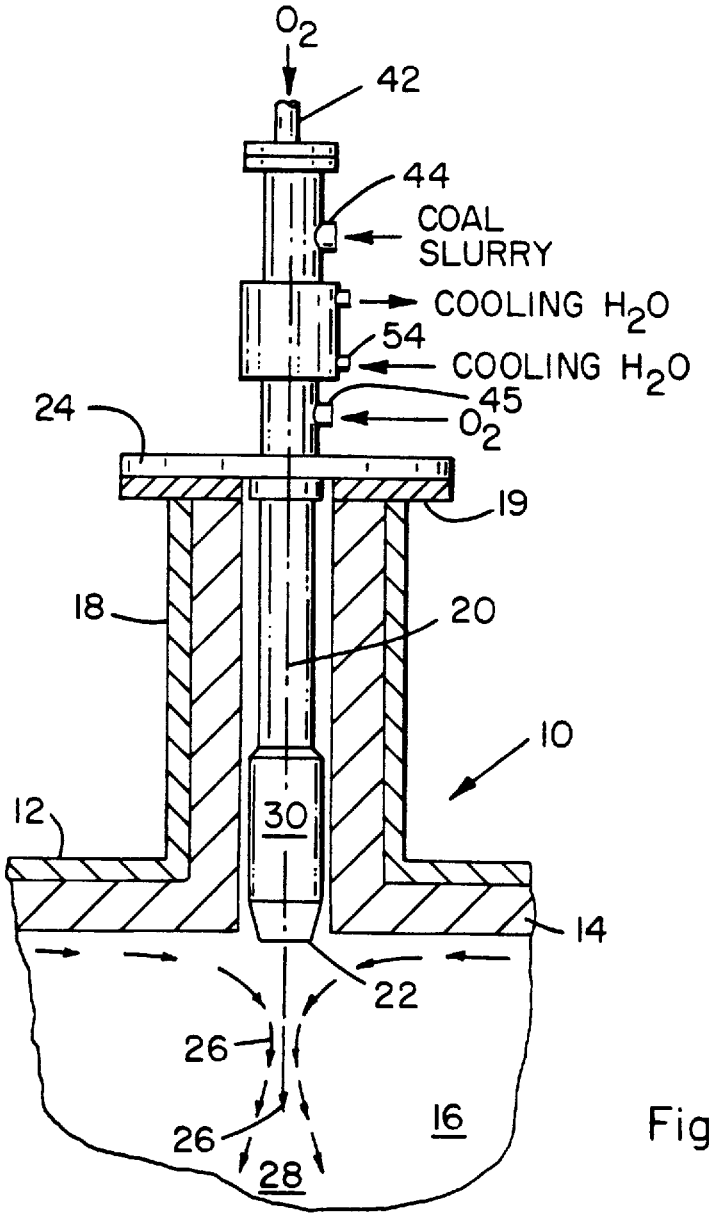
FIG. 1 is a partial sectional view of a synthesis gas generation combustion chamber and burner.

Relative to the drawings wherein like reference characters designate like or similar elements throughout the several figures of the drawing, FIG. 1 partially illustrates a synthesis gas reactor vessel 10 constructed with a structural shell 12 and an internal refractory liner 14 around an enclosed combustion chamber 16. Projecting outwardly from the shell wall is a burner mounting neck 18 for supporting an elongated fuel injection "burner" assembly 20 within the reactor vessel aligned to locate the face 22 of the burner head substantially flush with the inner surface of the refractory liner 14. A burner mounting flange 24 secured to the burner assembly 20 interfaces with a mounting neck flange 19 to secure the burner assembly 20 against the internal pressure of the combustion chamber 16.

Figure 2:
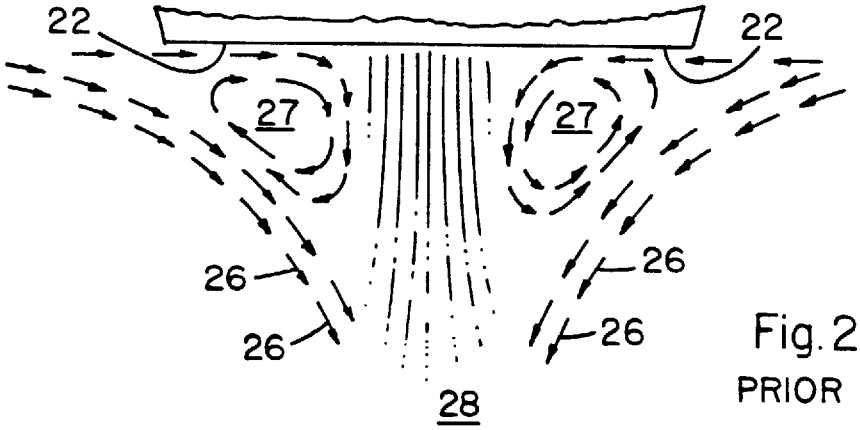
Fig. 2 PRIOR ART
FIG. 2 is a detail of the combustion chamber gas dynamics at the burner nozzle face.

Gas flow direction arrows 26 of FIGS. 1 and 2 partially represent the internal gas circulation pattern within the combustion chamber driven by the high temperature and high velocity reaction core 28 issuing from the nozzle assembly 30. Depending on the fuel and induced reaction rate, temperatures along the reaction core may reach as high as 2500° C. As the reaction gas cools toward the end of the chamber 16 opposite from the nozzle 30, most of the gas is drawn into a quench chamber similar to that of the synthesis gas process described by U.S. Pat. No. 2,809,104 to Dale M. Strasser et al. However, a minor percentage of the gas spreads radially from the core column 28 to cool against the reaction chamber enclosure walls. The recirculation gas layer is pushed upward to the top center of the reaction chamber where it is drawn into the turbulent down flow of the combustion column 28.

With respect to the prior art model of FIG. 2, at the confluence of the recirculation gas with the high velocity core column 28, a toroidal eddy flow 27 turbulently scrubs the burner head face 22 thereby enhancing opportunities for chemical reactivity between the burner head face material and the highly reactive, corrosive compounds carried in the combustion product recirculation stream.

One of the economic advantages of a coal fed synthesis gas process is the abundance of inexpensive, high sulfur coal which is reacted within the closed combustion chamber to release both free sulfur and hydrogen sulfide. From these sources, industrially pure sulfur and sulfur bearing compounds may be formed. Within the reaction chamber 16, however, such sulfur compounds tend to react with the cobalt base metal alloy materials from which the burner head face 22 is fabricated to form cobalt sulfide at extremely high temperatures. Since the cobalt fraction of this reaction is leached from the burner structure, a self-consumptive corrosion is sustained that ultimately terminates with failure of the burner assembly 20.

Although considerably cooler combustion product gases lay within the chamber 16 as a boundary layer against the refractory walls, the gases in direct, scrubbing contact with prior art burner nozzle faces tend to be extremely hot and turbulent.

Figure 3:
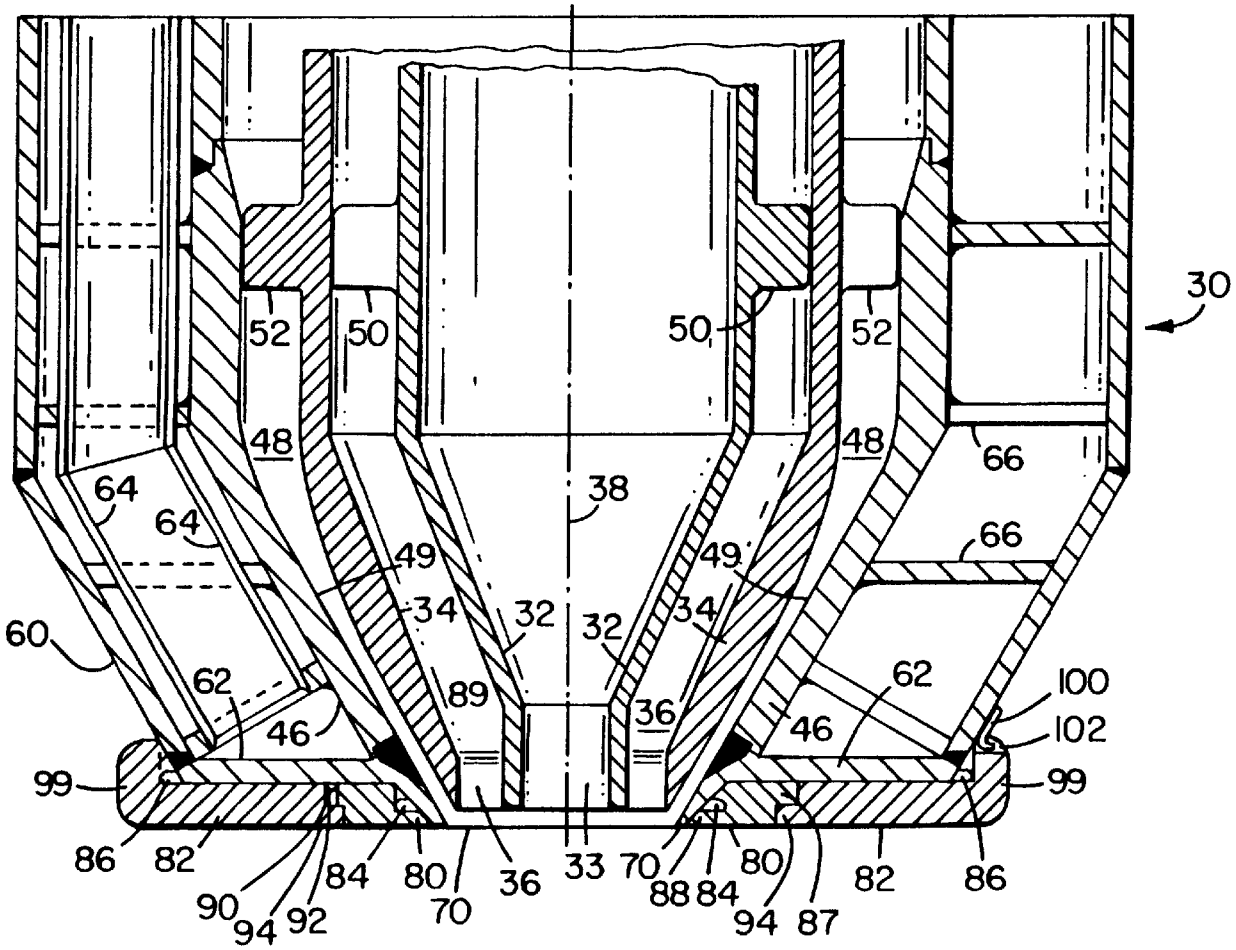
FIG. 3 is a sectional elevation view of a burner nozzle fitted with the present invention.

With respect to FIG. 3, the burner assembly 20 of the present invention includes an injector nozzle assembly 30 comprising three concentric nozzle shells and an outer cooling water jacket. The internal nozzle shell 32 discharges from an axial bore opening 33 the oxidizer gas that is delivered along upper assembly axis conduit 42. Intermediate nozzle shell 34 guides the particulated coal slurry delivered to the upper assembly port 44. As a fluidized solid, this coal slurry is extruded from the annular space 36 between the inner shell wall 32 and the intermediate shell wall 34. The outer, oxidizer gas nozzle shell 46 surrounds the outer nozzle discharge annulus 48 formed between the interior surface 49 of the outer shell and the outer surface of the intermediate shell 34. The upper assembly port 45 supplies the outer nozzle discharge annulus with an additional stream of oxidizing gas.

Centralizing fins 50 radiating from the outer surface of the inner shell 32 wall bear against the interior wall of the intermediate shell 34 to keep the inner shell 33 coaxially centered relative to the intermediate shell axis. Similarly, centralizing fins 52 radiate from the intermediate shell 34 to coaxially confine it within the outer shell 46. It will be understood that the structure of the fins 50 and 52 form discontinuous bands about the inner and intermediate shells and offer small resistance to fluid flow within the respective annular spaces.

As described in greater detail by U.S. Pat. No. 4,502,633 to D. I. Saxton, the internal nozzle shell 32 and intermediate nozzle shell 34 are both axially adjustable relative to the outer nozzle shell 46 for the purpose flow capacity variation. As intermediate nozzle 34 is axially displaced from the conically tapered internal surface of outer nozzle 46, the outer discharge annulus 48 is enlarged to permit a greater oxygen gas flow. Similarly, as the outer tapered surface of the internal nozzle 32 is axially drawn toward the internally conical surface of the intermediate nozzle 34, the coal slurry discharge area 36 is reduced.

Surrounding the outer nozzle shell 46 is a coolant fluid jacket 60 having a planar end closure 62. The end closure 62 includes a nozzle lip 70 that defines an exit orifice for the reaction materials discharged by the nozzle assembly. A coolant fluid conduit 64 delivers coolant such as water from the upper assembly supply port 54 directly to the inside surface of the end closure plate 62. Flow channeling baffles 66 control the coolant flow course around the outer nozzle shell assure substantially uniform heat extraction and prevention of coolant channeling and localized hot spots.

Preferably, most of the nozzle assembly 30 components are fabricated of extremely high temperature resistant materials such as an R30188 metal as defined by the Unified Numbering System for Metals and Alloys. This material is a cobalt base metal that is alloyed with chrome and tungsten. Other high temperature melting point alloys such as molybdenum or tantalum may also be used.

With continued reference to FIG. 3, the heat shield of the present invention comprises, for example, a pair of annular rings 80 and 82; both substantially concentric about the nozzle lip 70 and axis 38. These heat shield rings are formed from a high temperature melting point material such as silicon nitride, silicon carbide, zirconia, molybdenum, tungsten or tantalum. Representative proprietary materials include the Zirconia TZP and Zirconia ZDY products of the Coors Corp of Golden CO. Characteristically, these high temperature material rings should tolerate temperatures up to about 1400° C., include a high coefficient of expansion and remain substantially inert within a high temperature, highly reducing/sulfidizing environment.

Figure 4:
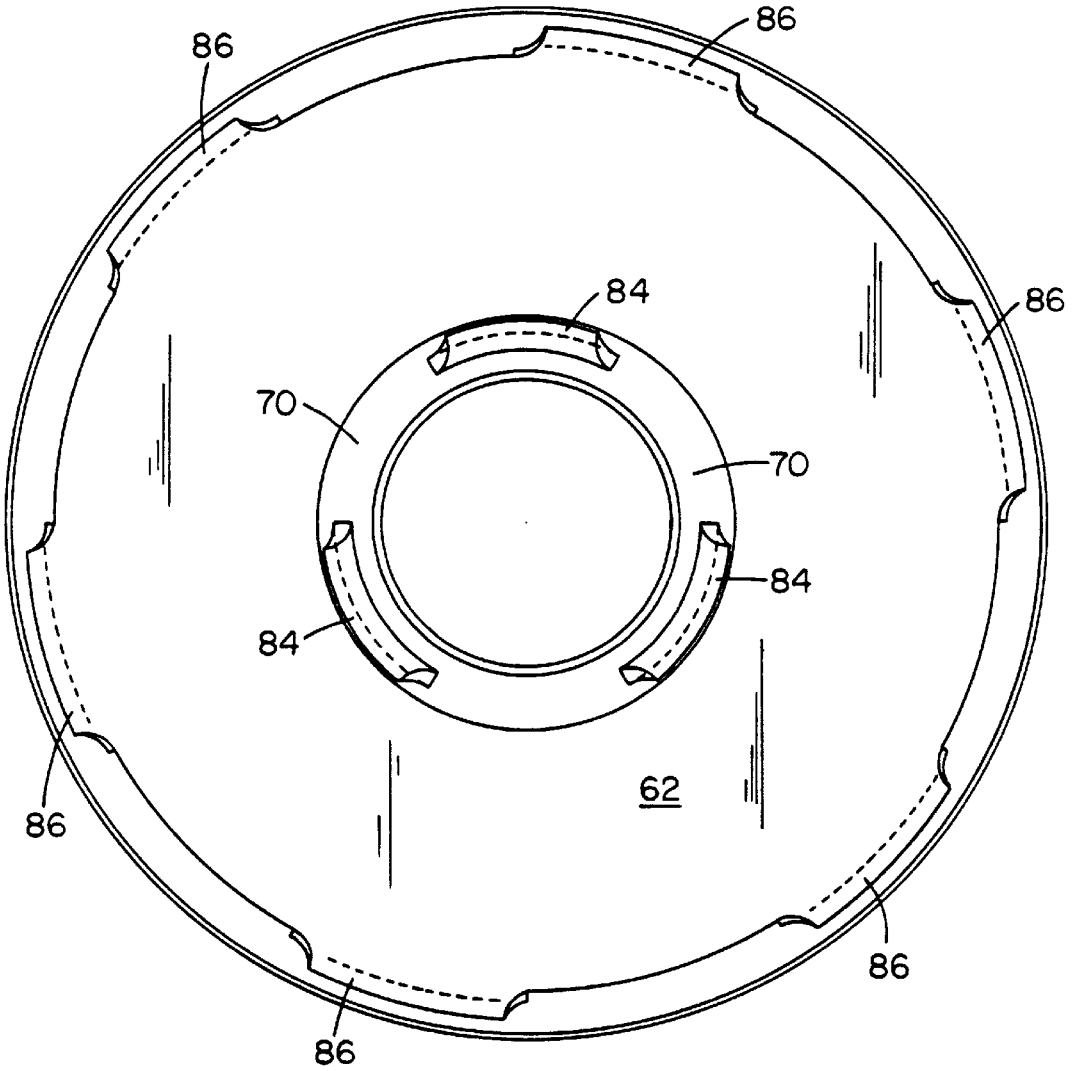
FIG. 4 is a plan view of the burner nozzle water jacket face.

To hold the rings 80 and 82 in place against the water jacket end plate 62, two sets of external ring lugs are machined into the water jacket end plate structure as shown by FIG. 4. The inner set of lugs 84 project substantially horizontally from the external conical surface of the lip 70. Each lug 84 element is fabricated about the lip 70 circumference with an arc that is about (180÷N) degrees, where N is the number of lug elements in the lug ring. For example, each lug in a 3 lug ring should have a ring arc of about 180°÷3=60°. These lugs 84 may be pitched to a thread lead but preferably, no more than about 5°.

The outer ring lug set 86 projects from the outer perimeter of the water jacket end wall 62. Similar to the inner ring lugs 84, each outer ring lug 86 is fabricated about the outer water jacket perimeter with an arc that is also about (180÷N) degrees. For an outer ring lug set 86 having six lugs, each has an arcuate length of about 30°. Like the inner ring lug set, the outer lugs may be thread lead pitched but preferably less than 5°.

Figure 5:
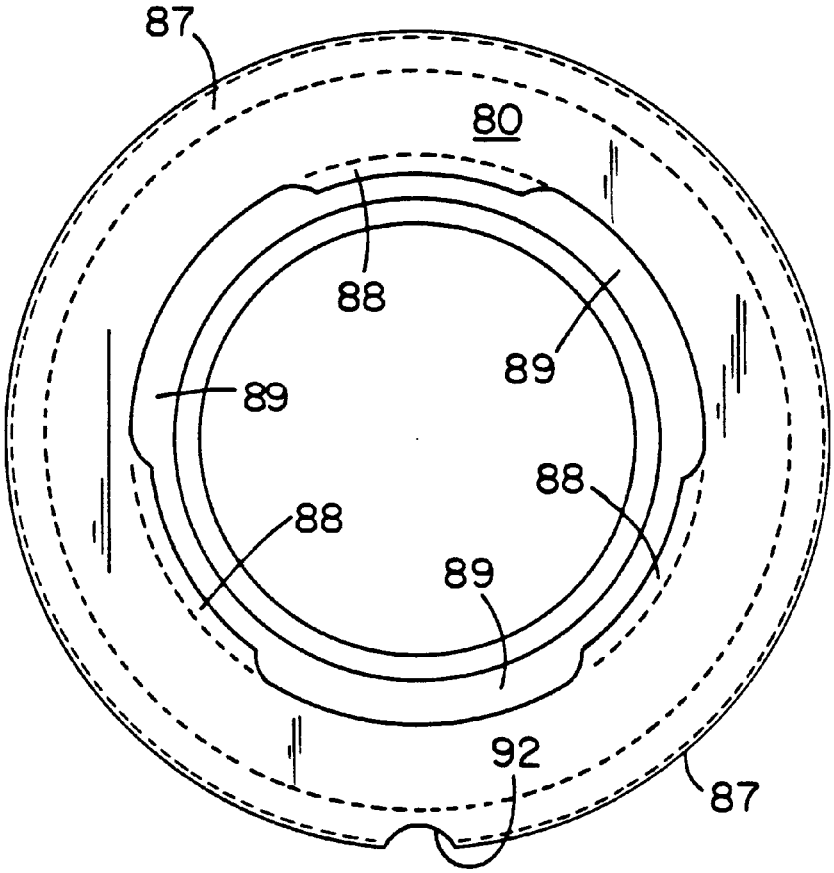
FIG. 5 is a plan view of the interior surface of inner high temperature material ring heat shield of the present invention.
Figure 6:
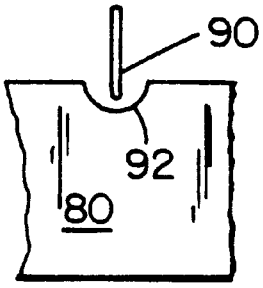
FIG. 6 is a plan view detail illustrating an antirotational device suitable for the invention; and, FIG. 7 is a plan view of the present invention outer ring.

With respect to FIGS. 3 and 5, the inner ceramic ring 80 comprises internal lug arcs 88 within a channel corresponding to the exterior lug arcs 84. To accommodate meshing access of the external lug projections 84 to the channel of the internal lug arcs 88, a triad of receiving openings 89 are provided. The inner ceramic ring 80 is secured to the inner set of external lugs 84 by inserting the external lug 84 axially through the receiving openings 89 into channel alignment and rotating the ring 80 to align the external lugs 84 in axial interference behind the internal lug arcs 88. In this relative positionment, a small rod or wire length 90 is spot welded to the face of the end closure 62 within the antirotational notch 92 in the outer perimeter of the ring, as shown by FIG. 6.

The outer perimeter of inner ring 80 is stepped with a lap bench 87 which is underlapped by the lap bench 94 of the outer ring 82. Relative to a cold assembly dimension, the nozzle assembly 30 expands upon heating longitudinally as well as radially. Since the internal nozzle shells are cooler than the external water jacket wall under operating temperature, the radially outer elements of the heat shield tend to move downward from thermal expansion relative to the radially inner elements. Hence, the lap joint between the inner ring 80 and the outer ring 82 is fashioned so that the horizontal gap between the inner and outer ring laps will open (increase) rather than close (decrease) with an increase in temperature. If the gap were allowed to close, increased temperature would tend to shear the lapping benches from their respective rings.

Figure 7:
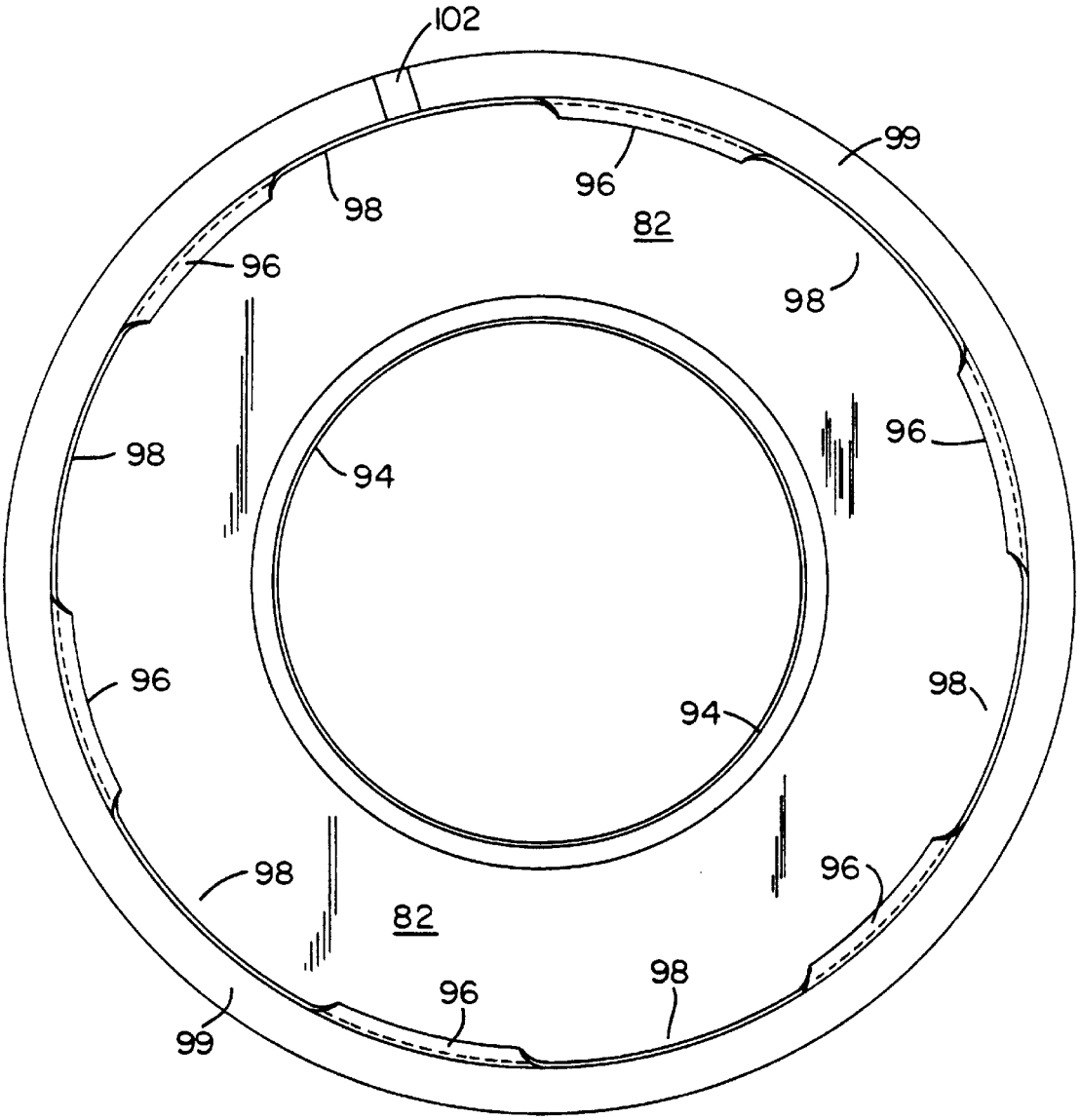

Outer ring 82 shown by FIG. 7 is similar to the inner ring with interior thread arcs 96 separated by relief cuts 98. However, it will be noted from FIG. 3 that the thread arc 96 and relief cut 98 are formed within a cuff bracket 99 around the outer perimeter of ring 82. As with the inner ring, an antirotational pin 100 is welded to the outer cooling jacket wall 60 for cooperative interference with the notch 102.

Also to be noted from FIG. 4 as different from the inner ring 80 is the number of arcs, six as opposed to three and the fact that the outer arcs, albeit are physically larger than the inner ring arcs, they are, in terms of arcuate size, are considerably smaller than the inner ring arcs.

Having described our invention in detail with particular reference to the preferred embodiment, it will be understood that variations and modifications can be implemented within the scope of the invention disclosed.

We claim:

1. A heat shielded burner nozzle assembly for injecting a fluidized fuel and oxidizing material into a high temperature combustion chamber, said assembly comprising:

a) a burner nozzle comprising an elongated outer shell having a longitudinal nozzle discharge axis and a plurality of elongated circumferentially reduced inner shells, said shells defining at least two annular channels surrounding a central channel and having upstream and downstream ends defining upstream and downstream orifices transected by said longitudinal axis, said downstream ends of said shells forming a burner head face having a first outer perimeter, said downstream end of said outer shell and said first outer perimeter of said burner head face defining a nozzle lip having a first thickness as measured along said longitudinal axis, and a outer surface, said nozzle lip having a first plurality of projections radially extending from said outer surface of said nozzle lip;

b) a coolant jacket defined by an annular end-face radially extending from said nozzle lip to a longitudinally extending cylindrical outer wall, said annular end-face having a second plurality of projections radially extending therefrom and defining a projection perimeter, wherein said coolant jacket envelopes said outer shell; and c) a heat shield ring assembly including an inner heat shield ring having a second thickness, a first inner face adapted to reside adjacent to said annular end-face and a first exterior face distal to said first inner face, a first inner perimeter adapted to reside adjacent to said nozzle lip and a first outer perimeter, said first inner perimeter defining an opening sufficient to receive said nozzle lip when said first inner face is positioned adjacent to said annular end-face, said inner heat shield ring having a first channel residing between said first inner face and said first exterior face, said first channel defining a first plurality of "L-shaped" openings correspondingly positioned relative to said first plurality of projections, each "L-shaped" opening extending from said first inner face across said first inner perimeter, wherein said first channel is sufficiently dimensioned for receiving said first plurality of projections when said first inner face is positioned adjacent to said annular end-face, whereby transaxial rotation of said inner heat shield ring about said nozzle lip causes said first plurality of protrusions to be received within said first channel to moveably affix said inner heat shield ring to said nozzle lip, and an outer heat shield ring having a third thickness, a second inner face adapted to reside adjacent to said annular end-face, and a second exterior face distal to said second inner face, said outer heat shield ring having a second inner perimeter defining an opening sufficient to receive said nozzle lip and a second outer perimeter radially located at least as far as said protrusion perimeter, wherein a portion of said inner heat shield ring longitudinally overlaps a portion of said outer heat shield ring, said outer heat shield ring including a cylindrical cuff bracket longitudinally extending from said second outer perimeter of said outer heat shield ring to beyond said second plurality of projections, said cuff bracket being adapted to radially surround said annular end-face, said cuff bracket having a fourth thickness, a third inner perimeter, a third outer perimeter, and an upper face extending between said third inner and outer perimeters, said third inner perimeter longitudinally extending from said second inner face of said outer heat shield ring between said second inner and outer perimeters thereof and being adapted to reside radially adjacent to said annular end-face, said third inner perimeter defining an opening sufficient to receive said annular end-face when said second inner face of said outer heat shield ring is positioned adjacent to said annular end-face, said cuff having a second channel residing between said upper face of said cuff bracket and said second inner face of said outer heat shield ring, said second channel defining a second plurality of "L-shaped" openings correspondingly positioned relative to said second plurality of projections, each second "L-shaped" opening extending from said upper face across said third inner perimeter, wherein said second channel is sufficiently dimensioned for receiving said second plurality of projections when said second inner face of said outer heat shield ring is positioned adjacent to said annular end-face, whereby transaxial rotation of said outer heat shield ring about said annular end-face and said nozzle lip causes said second plurality of projections to be received within said second channel to moveably affix said outer heat shield ring to said annular end-face.

2. The heat shielded burner nozzle assembly of claim 1 wherein said first outer perimeter of said inner heat shield ring and said second inner perimeter of said outer heat shield ring are step-wise adapted for said second inner perimeter to reside adjacently longitudinally beneath and adjacently radially about said first outer perimeter, whereby defining said overlapping portions of said inner and outer heat shield rings.

3. The heat shielded burner nozzle assembly of claim 2 wherein said first outer perimeter and said second inner perimeter are adapted so that said first and second inner faces of said inner and outer heat shield rings are essentially in a same plane when said first and second inner faces are positioned adjacent to said annular end-face.

4. The heat shielded burner nozzle assembly of claim 1 wherein the second and third thicknesses of said inner and outer rings are substantially equal.

5. The heat shielded burner nozzle assembly according to claim 1 wherein said heat shield ring assembly is formed from a material having a high melting point, a high coefficient of thermal expansion, a high fracture toughness, and a greater resistance to a high temperature combustion chamber environment, compared to the materials forming the remainder of said burner nozzle and said coolant jacket.

6. The heat shielded burner nozzle assembly according to claim 5 wherein said heat shield ring assembly is formed from a silicon nitride, a silicon carbide, a zirconia based ceramic, a molybdenum metal alloy, tungsten, or tantalum.

7. The heat shielded burner nozzle assembly according to claim 1 wherein said central channel is configured to deliver an oxidizer gas stream and said at least two annular channels includes an annular channel configured to deliver a slurried fuel stream, surrounded by another annular channel configured to deliver an oxidizer gas stream.

8. The heat shielded burner nozzle assembly according to claim 1 wherein said annular end-face and said first and second plurality of projections lie substantially perpendicular to said longitudinal axis.

9. The heat shielded burner nozzle assembly according to claim 1 wherein said annular end-face and said first and second plurality of projections are shielded against an influx of a combustion product recirculation stream in the combustion chamber when said inner heat shield ring is affixed to said nozzle lip and said outer heat shield ring is affixed to said annular end-face.

10. The heat shielded burner nozzle assembly of claim 1 wherein said outer surface of said nozzle lip is conical.

11. The heat shielded burner nozzle assembly according to claim 1 wherein said first and second plurality of projections extend transrotationally transverse to the longitudinal axis, thereby defining an arcuate length for each projection.

12. The heat shielded burner nozzle assembly according to claim 1 wherein said first plurality of projections consists of three projections and said second plurality of projections consists of six projections.

13. The heat shielded burner nozzle assembly according to claim 1 further comprising a plurality of welding rods, wherein said inner and outer heat shield rings are adapted to be fixedly welded to said annular end-face by way of a welding rod.

* * * * *